United States Patent [19]

Wurst

[11] Patent Number: 5,066,078

[45] Date of Patent: Nov. 19, 1991

[54] FURNITURE TOP INSERT FEATURING LANDSCAPE

[76] Inventor: Michael Wurst, 6205 S. Knoll Dr., Edina, Minn. 55436

[21] Appl. No.: 626,786

[22] Filed: Dec. 13, 1990

[51] Int. Cl.[5] ..... A47F 3/00; 312 204; 312 223; 312 114; 312 242; 108 23; 40 160

[52] U.S. Cl. ..... 312/114; 312/204

[58] Field of Search ..... 312/204, 223, 114, 242; 108/23; 40/160

[56] References Cited

U.S. PATENT DOCUMENTS

| | | | |
|---|---|---|---|
| 16,998 | 11/1886 | Morris . | |
| D. 58,296 | 7/1921 | Wurth . | |
| D. 245,823 | 9/1977 | Fields . | |
| D. 250,865 | 1/1979 | Finch . | |
| 1,591,095 | 7/1966 | Meyer . | |
| 1,887,288 | 11/1932 | Clausen | 108/23 |
| 2,196,230 | 4/1940 | Randel . | |
| 3,110,532 | 11/1963 | Nail | 312/214 |
| 3,792,543 | 2/1974 | Powell | 40/160 |
| 3,822,494 | 7/1974 | Zivica | 40/160 |
| 4,185,407 | 1/1990 | Lamb | 40/152.2 X |
| 4,438,579 | 3/1984 | Engel | 40/160 |
| 4,594,950 | 6/1986 | Morris . | |
| 4,960,308 | 10/1990 | Donaghy | 312/204 X |

*Primary Examiner*—Joseph Falk

*Attorney, Agent, or Firm*—Haugen and Nikolai

[57] ABSTRACT

A furniture top insert holds a scale model of a familiar landscape within a recess and is protected by a double layer of transparent material. The furniture top is constructed to be inserted within the edges of a table, cabinet, credenza or the like and lie flush with the supper surface of the furniture. Within the recess, miniature trees, shrubs, ponds, turf, walkways or driveways, and other replicas of landscape features are placed so that they accurately depict a known landscape, such as a particular hole at a famous golf course. The frame for the landscape is made primarily of wood, reinforced with braces to support the weight of the scale model and its protective transparent bilayer. Exposed regions of the frame are constructed from finished wood, or may comprise a veneer of a variety of materials to provide a variety of ornamental appearances. This decorative combination gives the illusion of a bird's -eye view of the landscape scene while providing a functional surface that permits the furniture piece to be used in the usual, intended manner.

9 Claims, 1 Drawing Sheet

FURNITURE TOP INSERT FEATURING LANDSCAPE

BACKGROUND OF THE INVENTION

I. Field of the Invention

This invention relates generally to the design of furniture and more particularly to a table displaying a three-dimensional rendition of a landscape scene, such as a golf course scene, that has been recessed under a transparent table top. The construction of the recess in combination with the glass covering gives the appearance of a bird's eye view of the layout of, say, a hole at a famous golf course.

II. Discussion of the Prior Art

Glass tops on articles of furniture are well-known in the art. The glass can serve as a decorative support or it may form a functional part of a landscape.

Decorative support table tops made of glass come in various geometrical sizes and are supported by a variety of bases. An example of an atypical base is the use of a cyprus knee or root as a base for a pane of glass. Driftwood is also a popular base, as are animal antlers and horns.

A typical ornamental use of glass table tops in landscape scenes are those wherein the glass is intended to depict the surface of water, such as a lake or pond surface. In U.S. Pat. No. 4,594,950 to Morris, there is shown a decorative table in which objects on the surface of the glass appear to emerge from a natural body of water. Animals or waterfowl are constructed so that an upper part of the figure is supported on top of the table top and a lower part is supported on the lower surface of the table top, thus representing the submerged portion of the animal or waterfowl. The two portions can be held together magnetically, allowing them to be moved along the surface. Supports for the glass table top are constructed to depict a natural part of the landscape, such as water lilies or submerged tree trunks. Also, the hue of the glass is varied to more accurately depict the nature of the water found at that particular scene.

Three dimensional terrarium-type landscapes are also known. An example is U.S. Pat. No. 2,196,230 to Randel, which describes an artificial miniature landscape in which trees, shrubs and other objects are formed from natural sponge. The sponge is trimmed to form an artistic assembly in combination with miniature figurines and furniture that extend above the surface of the terrarium.

Turning now to prior art golf course facsimiles, a three dimensional surface which is used as a playing field is disclosed in U.S. Pat. No. 1,591,095 (Meyer). This indoor golf game features a rug-like covering over a rolling "layout" and having a nap, fibers or similar surfacing of different lengths in order to simulate rough, hazards, putting greens and other features of a regulation outdoor golf course. It is fitted into a room or rooms of a building of comparatively confined or limited area but is not embodied as decoration in an item of furniture.

OBJECTS

It is accordingly a principal object of the present invention to provide an article of furniture incorporating an accurately scaled, three-dimensional depiction of a scene.

It is another object to provide an article of furniture having a glass top which serves a display function, permitting viewing of an ornamental but physically accurate scaled model of a famous landscape that has been recessed into the top surface of the furniture.

SUMMARY OF THE INVENTION

The foregoing objects and advantages of the invention are achieved by providing an article of furniture, such as a coffee table or the like, having a box-like recess formed therein where the top surface of the recess is to be covered with a sheet of transparent material. Constructed o the floor of the box-like recess is a scale, three-dimensional model of a particular landscape, such as a famous golf hole scene. The recess is covered by a protective transparent barrier. More particularly, four lateral support walls define the box-like recess and also support a first protective transparent barrier on the upper surface thereof. A second transparent barrier comprising the table top spans the entire length and width of the inset and rests upon support posts that are located at spaced locations around the perimeter of the recess. Thus, two transparent barriers protect the scale model disposed within the recess.

The aforementioned objects and advantages of the invention will become subsequently apparent and reside in the details of construction and operation as more fully hereinafter described and claimed, reference being had to the accompanying drawings forming a part thereof, wherein like numerals refer to like parts throughout.

DESCRIPTION OF THE PREFERRED EMBODIMENT

Figure 1:
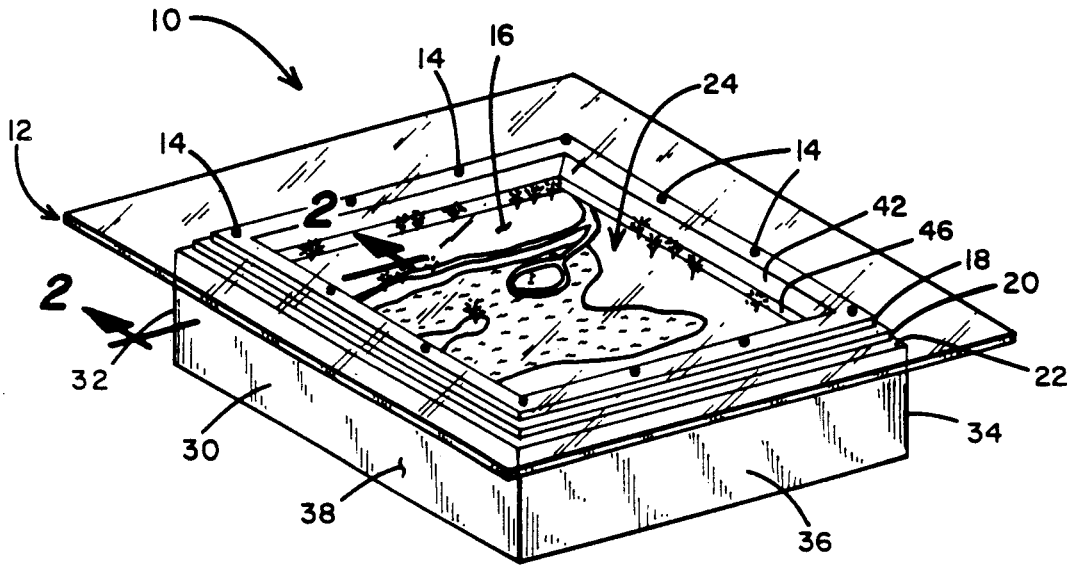
FIG. 1 depicts a perspective view of the preferred embodiment.

A preferred embodiment of an item of furniture for displaying a scale model of a scene, such as a hole from a familiar golf course, is shown in the perspective view of FIG. 1 It is envisioned that other famous landscapes such as battle grounds, etc. could be embodied into this recess, but with no limitation intended, the invention will be explained with reference to facsimiles of famous golf courses and holes at such courses. In this drawing, there is depicted a perspective view of a piece of furniture such as a coffee table 10 having a generally square or rectangular perimeter. A heavy pane of glass or plexiglass 12 forms the upper transparent table top surface and is of sufficient thickness, for example, having a thickness of ¾", to be able to support the weight of objects or persons who may choose to sit or lean thereon. The pane of glass 12 is supported on a series of frictional support pegs 14, preferably of black hard rubber ¾" in diameter, positioned around the perimeter of an ornamental top surface 16 that surrounds the central core of the table 10. These pegs 14 are mounted on a support strip 18, which may be made from a variety of materials such as wood, faux marble or sheet metal. To prevent the glass 12 from shifting, these pegs 14 are inserted into holes intermittently bored along support strip 18. The size of the holes is adequate to securely retain the ¾" pegs 14 to a depth of approximately ½ inch. A second support strip 20 of the same or a different material is slightly offset from support strip 18 and assists in providing additional depth to the unit. A final facing piece 22 adds additional height and depth around the perimeter of the central display area 24.

Figure 2:
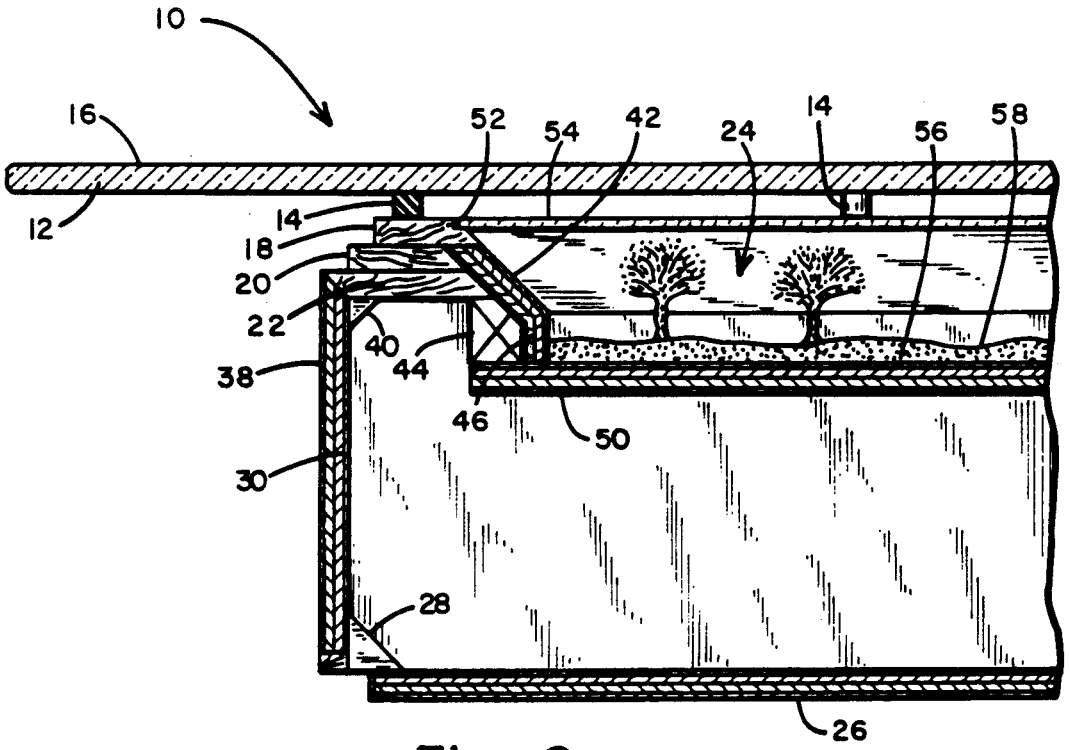
FIG. 2 depicts a cross-section view taken along the line 2—2 in FIG. 1 revealing internal construction of the preferred embodiment.

FIG. 2 depicts a cross-section view of a portion of the table 10, along the line 2—2 of FIG. 1. It shows the outer heavy glass table top 12 resting on pegs 14. The coffee table further includes a rectangular base 26 which may be fabricated from plywood, chip board or other similar material and which will have a decorative lamination on at least the exterior surface thereof. This base is preferably 3'6" by 3'6" and between 1' to 1½' high, while the glass top 12 is preferably 5' by 5'. A brace 28 of a triangular cross-section may be screwed and glued to the base 26 around the periphery thereof to provide a support structure to which the four mutually perpendicular side walls 30, 32, 34 and 36 are joined.

The side walls 30 through 36 are also shown as being formed from plywood and include an exterior veneer 38 which may be wood grained, faux marble or metal, depending upon the "look" that one desires.

A bevelled edge is formed between the side walls 30 through 36 and the inwardly extending top support piece 22. A triangular brace or gusset 40 is disposed between these two members to provide a screwed and glued joint. The support strips 18 and 20 have the inner edge thereof cut at a predetermined angle, as does the piece 22, and a facing board 42 is supported on the inclined surface. A brace 44 which is hidden from view is joined to the facing board 42 and to the top support piece 22 as well as to a vertically extending plywood strip 46 which forms the perimeter of the box in which the scene 24 is to be displayed.

Affixed to the braces 44 and forming the horizontal bottom of the display box is a further plywood or chip board sheet 50 which is preferably held in place by screws (not shown) extending through the bottom board 50 and into the perimeter braces 44.

The support strip 18 has a notched and angled edge 52, dimensioned to receive a second pane of transparent material, such as glass panel 54, which extends over the central core 24. In that the heavy glass top 12 shields the lower pane 54, it need not be as thick. For example, a pane of ¼" glass would suffice for lower pane 54.

Contained within the box-like enclosure defined by the glass pane 54, the bottom board 50 and the mutually perpendicular peripheral walls is the scene to be displayed. As can best be seen in FIG. 1, when depicting a golf hole, it shows the tee, the green, the fairway and other prominent features. In creating the scene, it has been found convenient to take aerial photos and then apply an appropriate scale so that the hole can be made to occupy substantially the entire surface of the bottom board 50. A variety of materials including various plastics, fabrics, minerals, etc. are used in creating a realistic looking scene. For example, sandtraps, water holes, trees and other objects may be included to add to the realism. A support matrix 56, preferably of a material that will retain its shape such as styrofoam, is placed adjacent to the lower surface 50, preferably of ¾" plywood. It is cut to accurately resemble the contour of the desired landscape, then covered with turf-like fabric 58. Using other known materials, such as sand, glass and commercial replicas manufactured for model railways, virtually any landscape can be accurately replicated to scale.

This invention has been described herein in considerable detail in order to comply with the Patent Statutes and to provide those skilled in the art with the information needed to apply the novel principles and to construct and use such specialized components as are required. However, it is to be understood that the invention can be carried out by specifically different equipment and devices and that various modifications, both as to equipment details and operating procedures, can be accomplished without departing from the scope of the invention itself.

What is claimed is:

1. A furniture item for displaying a scale, three-dimensional model of a scene comprising in combination:

(a) a box-like enclosure sealed from an ambient including a floor panel with four mutually perpendicular side walls extending upwardly therefrom, each having a top edge and a bottom edge, and an upper edge surface extending from said top edge of said side walls, the upper edge surface having an inner periphery including a rectangular notch;

(b) a rigid transparent sheet having its edges fitted into said rectangular notch;

(c) a three-dimensional scaled replica of a prominent geographical scene resting on and substantially covering said floor panel beneath said rigid transparent sheet; and (d) a rigid, inflexible transparent top member disposed in spaced apart but covering relation with respect to said rigid transparent sheet.

2. The furniture item as in claim 1 and further including a frame supporting said box-like enclosure.

3. The furniture item as in claim 2 wherein said frame includes:

(a) a planar base;

(b) four mutually perpendicular walls extending vertically upward from said planar base; and (c) a top member secured to said four walls, said top member including an opening therethrough defining opening walls, said box-like enclosure securingly disposed in said opening nearly proximate said opening walls.

4. The furniture item as in claim 3 and further including a plurality of friction pegs projecting upward from said top member at regularly spaced intervals, said transparent top member resting upon said friction pegs.

5. The furniture item as in claim 3 wherein the exterior surface of said four walls comprises a decorative veneer.

6. The furniture item as in claim 5 wherein said veneer is wood.

7. The furniture item as in claim 5 wherein said veneer is stainless steel.

8. The furniture item as in claim 5 wherein said veneer is faux marble.

9. The furniture item as in claim 1 wherein said three-dimensional scene is a golf hole.

* * * * *